US006616369B2

(12) United States Patent
Clark

(10) Patent No.: US 6,616,369 B2
(45) Date of Patent: Sep. 9, 2003

(54) QUICK RELEASE DELINEATOR APPARATUS

(75) Inventor: Richard O. Clark, Stephenville, TX (US)

(73) Assignee: Flexco, Stephenville, TX (US)

( * ) Notice: Subject to any disclaimer, the term of this patent is extended or adjusted under 35 U.S.C. 154(b) by 0 days.

(21) Appl. No.: 10/189,878

(22) Filed: Jul. 3, 2002

(65) Prior Publication Data

US 2002/0168225 A1 Nov. 14, 2002

Related U.S. Application Data

(63) Continuation-in-part of application No. 09/519,800, filed on Mar. 6, 2000, now Pat. No. 6,416,248, which is a continuation-in-part of application No. 09/233,836, filed on Jan. 20, 1999, now Pat. No. 6,036,400.

(51) Int. Cl.[7] ..... G01F 9/00; G09F 15/00

(52) U.S. Cl. ..... 404/10; 404/9; 116/63 R; 40/606; 40/607; 248/222.41; 403/348

(58) Field of Search ..... 404/6, 9, 10, 11; 116/63 R, 63 C; 40/606, 607, 611, 612; 248/222.41, 222.51, 222.52, 223.21, 551; 403/348, 350

(56) References Cited

U.S. PATENT DOCUMENTS 3,082,985 A * 3/1963 Herdman ..... 248/103
3,564,984 A * 2/1971 Alexander ..... 359/551
D230,235 S * 2/1974 Green et al. ..... D6/495
3,902,818 A * 9/1975 Boone ..... 404/10
4,385,577 A * 5/1983 Graham ..... 112/258
4,596,489 A * 6/1986 Mariol et al. ..... 404/10
4,773,788 A * 9/1988 Ruhl ..... 403/24
4,806,046 A * 2/1989 Clark ..... 404/10
5,197,819 A * 3/1993 Hughes ..... 404/13
5,199,814 A * 4/1993 Clark et al. ..... 404/10
5,688,030 A * 11/1997 McAnally et al. ..... 312/223.2
D420,890 S * 2/2000 Kuhnke ..... D8/354
6,019,543 A * 2/2000 Junker ..... 404/10

* cited by examiner

*Primary Examiner*—Gary S. Hartmann
(74) *Attorney, Agent, or Firm*—Jackson Walker L.L.P.

(57) ABSTRACT

An impact recovery delineation quick connect/disconnect adapter system having studs and an alignment pin that enables an operator to connect and/or disconnect a delineation panel, support post and load cell from the supporting base (fixed or portable) without the use of any tools. The load cell provides for radially aligned slots in a shoulder portion to allow the load cell to engage and lock with studs that are connected to the supporting base when the load cell is rotated about its vertical axis. The studs are particularly geometrically configured and have shoulders that are larger than the stud barrel and have heads that are larger than the shoulders which results in a mechanical locking between the slots and the studs upon rotation of the cell with respect to the stationary studs. A quick release detent pin passes through aligned passages in the lower load cell element and supporting base to prevent rotation of the load cell with respect to the horizontal axis of the base after connection is achieved. The detent pin may be secured within and extend through the lower load cell element to ensure the release of the lower load cell element from the base member while remaining affixed to the lower load cell element. A portable support surface assembly has a fixed base that is molded into and is an integral part of the portable support surface.

9 Claims, 7 Drawing Sheets

QUICK RELEASE DELINEATOR APPARATUS

BACKGROUND OF THE INVENTION

This is a continuation-in-part application of U.S. application Ser. No. 09/519,800, filed Mar. 6, 2000, now U.S. Pat. No. 6,416,248, issued Jul. 9, 2002, which is a continuation-in-part of U.S. application Ser. No. 09/233,836, filed Jan. 20, 1999, now U.S. Pat. No. 6,036,400, issued Mar. 14, 2000.

The present invention relates to highway delineator systems; and more particularly to an apparatus for rapid, easy connecting and disconnecting of the delineator post from the base (whether fixed or portable).

U.S. Pat. No. 4,806,046 and U.S. Pat. No. 5,199,814 disclose art relating to an impact recovery delineation system that uses threaded connectors to rigidly connect the load cell assembly to the support base (fixed base and/or portable base). However, certain features still exist with such systems, and specifically those taught in U.S. Pat. No. 5,199,814 which the present invention seeks to improve. U.S. Pat. Nos. 6,036,400 and 6,416,248 teach and disclose a quick release system for use with delineators which significantly improves the interchangeability of signage affixed to the support base. The present invention further improves the stability and alignment of such combinations.

Delineator posts and delineation panels used to mark travel ways and to identify the existence of hazardous objects are often impacted by vehicles and damaged thereby requiring replacement. It is also desirable to use delineation on a frequent and temporary basis while allowing the base support to remain permanently located. Separation of the base support and delineation post and signage panel is also desirable for more convenient transporting and storage of the delineation systems. The use of threaded connectors to attach the load cell to the base support is labor time consuming, awkward and requires the use of tools. The removal of the connectors with the use of tools is often performed by workers under heavy traffic conditions and this exposure can be very dangerous to the worker.

Consequently, it is desirable to provide a means to quickly connect and disconnect the load cell with delineator post and delineation panel from the support base and still provide a rigid connection that will withstand multiple, high speed impact forces when struck by an automobile vehicle.

The improvements of the present system allow for the load cell to be connected to the support base (fixed base or portable base) quickly by engaging studs (having a head larger than the shoulder) in the support base into slotted, openings in the lower load cell element by a rotational action of the load cell element about its vertical axis. This may be accomplished without the use of any tools. A quick release detent pin or pins pass through aligned passages in the lower load cell element and the supporting base to prevent rotation of the load cell element about its vertical axis with respect to the horizontal axis of the base. The load cell element may be quickly disconnected from the support base by pulling the quick release detent pin(s) from the aligned passage in the support base and lower load cell element and counter rotating the load cell element about its vertical axis with respect to the horizontal axis of the support base, thereby disengaging the slotted lower load cell element from the stationary studs. The post and affixed signage may be thereafter separated.

SUMMARY OF THE INVENTION

The present invention provides an impact recovery delineation quick connect/disconnect system that is capable of connecting the load cell having a delineator post and delineation panel to the base support without the use of any tools thereby minimizing the time required to perform such functions. Quick release detent pins ensure that the signage does not rotate during normal traffic installation.

The present invention provides for slotted openings in the lower load cell element thereby allowing the load cell element to be used with studs or with its conventional threaded connection to be base support.

This invention further provides novel studs that are attached to the base support (fixed and portable) which enable the load cell assembly with or without an adapter plate to be connected to the base support without the use of tools but rather by a rotational action between the two members.

The invention also incorporates a quick release detent pin that prevents counter rotation of the load cell assembly about its vertical axis to insure the load cell assembly and base support are not unintentionally disconnected.

The invention provides for a rigid connection between the load cell and base support that will withstand multiple, high speed impacts from automobile vehicles.

DETAILED DESCRIPTION OF THE PREFERRED EMBODIMENT

Figure 1:
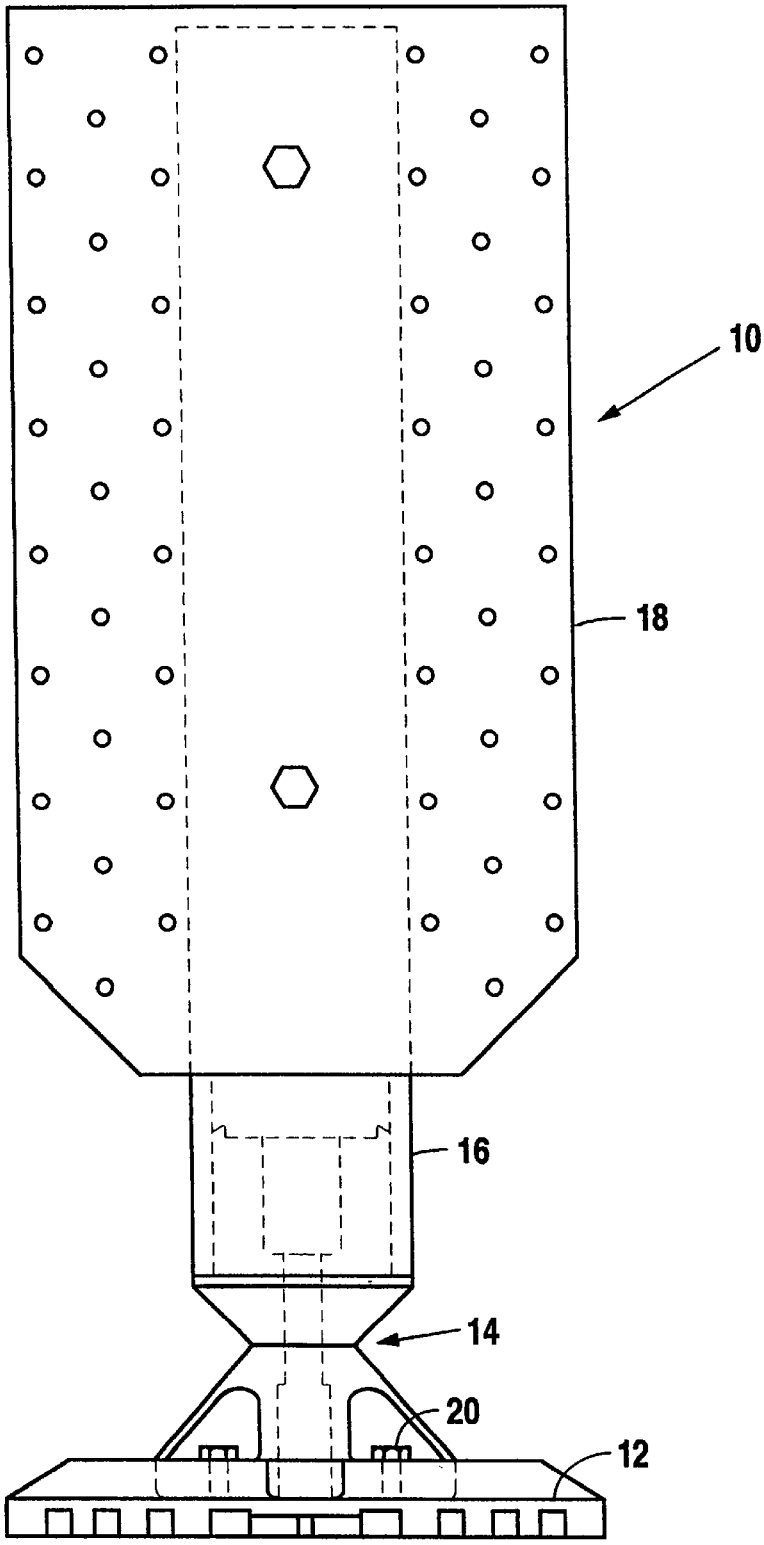
Fig. 1 (PRIOR ART)
FIG. 1 is a side elevational view of the prior art.

Referring now to the drawings and first to FIG. 1, an impact recovery delineator system of the prior art is illustrated generally at 10 and incorporates a base 12, a load cell assembly 14, (made up of upper load cell element 21 and a lower load cell element 22), and a delineator post 16. The post is provided with a reflective signage panel 18. It should be understood that panel 18 may be any of a number of various types of traffic control panels including, but not limited to, channeling devices, speed limit signage, barriers, stop signs, and construction informational signage, and their structural and functional equivalents. Some of these traffic control panels are marketed by Impact Recovery Systems, San Antonio, Tex., under its trademark One Base® series delineators.

The signage 18, post 16, and load cell assembly 14 are securely attached to the base 12 by common bolting fasteners 20. In order to remove the post 16, generally four fasteners must be removed. Often the fasteners have become rusted, dirty or otherwise degraded, making removal difficult and time-consuming even with specialized tools.

Figure 2:
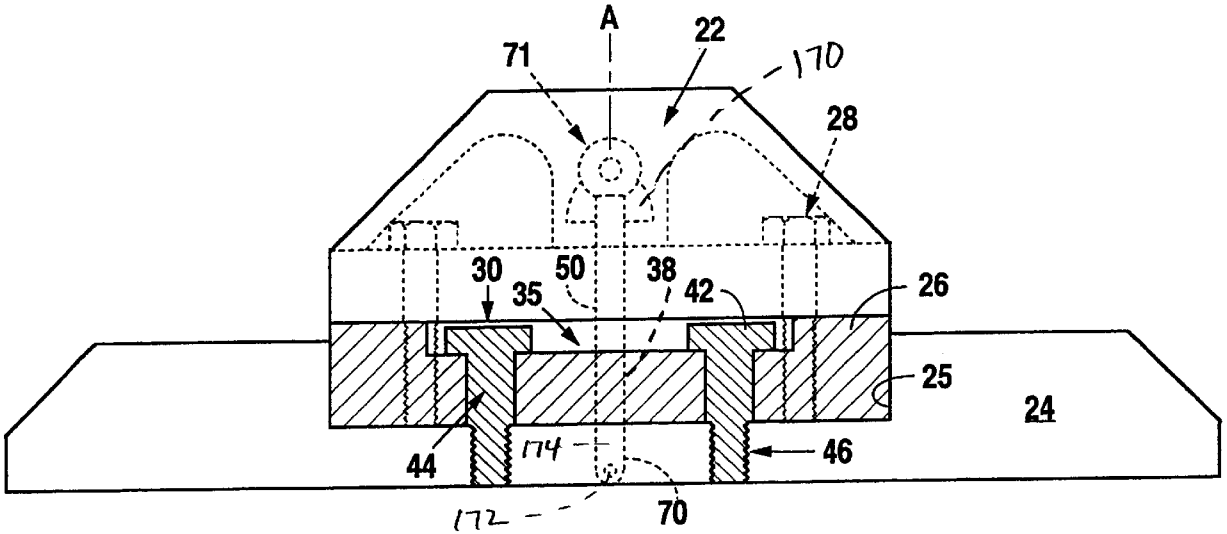
FIG. 2 is a cross-sectional view of the present invention with an adapter plate.

FIG. 2 illustrates a side elevational cross-section view of the present invention showing the structural relationship of a lower load cell element 22 and a base 24 with the adapter plate 26 of the present invention. Plate 26 is attached to the load cell element by bolts 28 which are threadingly secured through the load cell element to the plate 26. The plate 26 is detachably affixed to base 24 by plate studs 30 which are fastened securely to base 24 by threaded ends 46.

Plate 26 is provided with radially aligned slots or openings 34 (FIG. 3) in recessed platform 35. Slots 34 receive studs 30 in rotating engagement as will be discussed below. Stud heads 42 hold the plate 26 in engagement with the base 24 when the lower load cell element 22 is rotated about its vertical axis A (FIG. 2).

Figure 3:
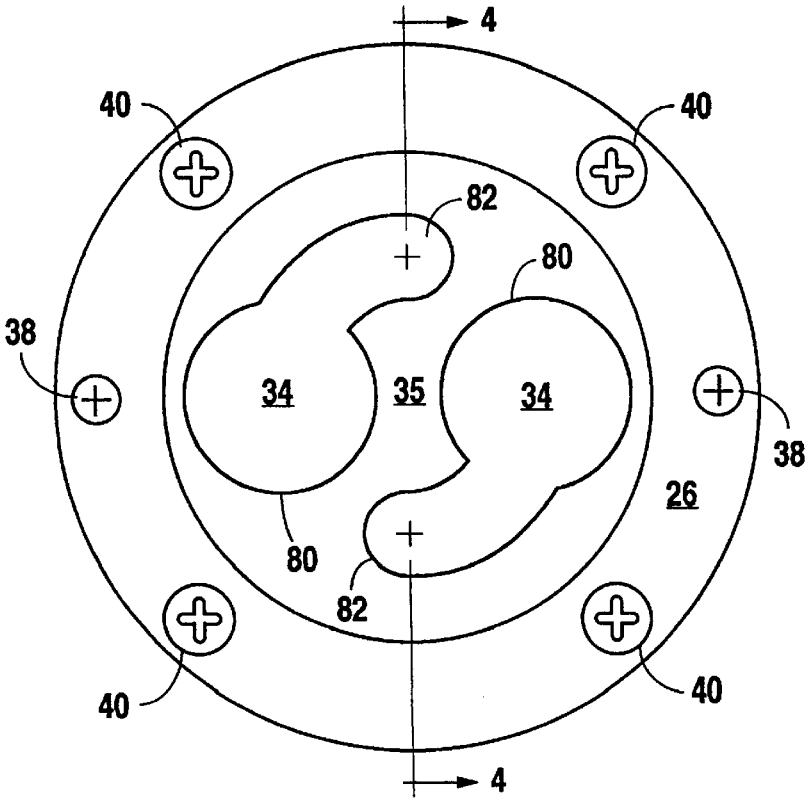
FIG. 3 is a top view of the adapter plate of the present invention.

FIG. 3 shows the adapter plate 26 in a top plan view. Recessed platform 35 contains the radially aligned slots 34 and allows the stud head 42 sufficient clearance for rotation. Along the perimeter of the plate 26 are a number of openings. Adapter detent passages 38 are intended to accept detent pins 71 when the delineator system is properly assembled. Threaded openings 40 are for receiving suitable threaded fasteners 28 (FIG. 2) to secure the plate 26 to the lower load cell element 22.

Figure 4:
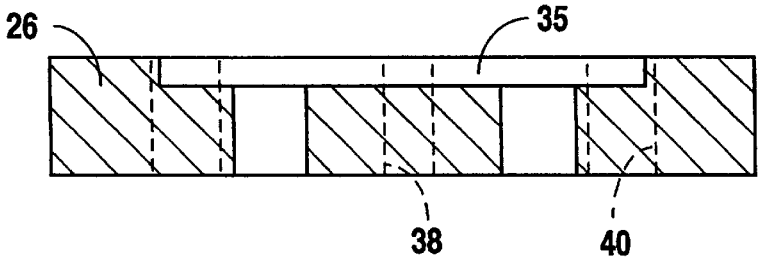
FIG. 4 is an elevational cross-sectional view of the adapter plate of the present invention taken along line 4—4 of FIG. 3.

FIG. 4 is a cross sectional view of the plate 26 taken along line 4—4 of FIG. 3. This figure shows the relationship of adapter detent passages 38, threaded openings 40 and the recessed platform 35.

Figure 5:
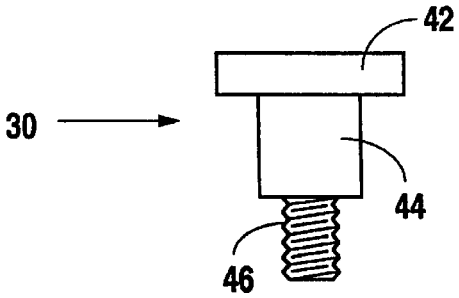
FIG. 5 is an elevational view of the plate stud of the present invention.

FIG. 5 illustrates an elevational view of the studs 30 of the present invention. Stud 30 has a head portion 42, a shoulder portion 44, and a threaded base portion 46. Shoulder 44 is larger in diameter than the threaded base to prevent the stud 30 from falling through the base 24.

Figure 6:
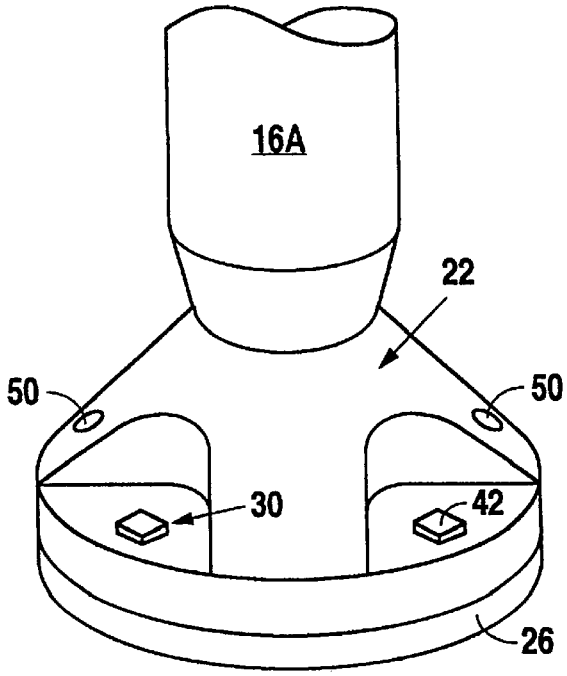
FIG. 6 is a top side perspective of the post, lower load cell element and adapter plate.

FIG. 6 shows a perspective view of post 16A (with upper load cell element 21A) and lower load cell element 22 attached to plate 26 by bolts 30 having heads 42. Load cell detent passages 50 extend through cell element 22 and align with adapter detent passage 38 in the plate 26. When the post 16A is properly attached to base 24, passages 50 and 38 align with passage 70 in base 24 and will receive detent pin 71.

Figure 7:
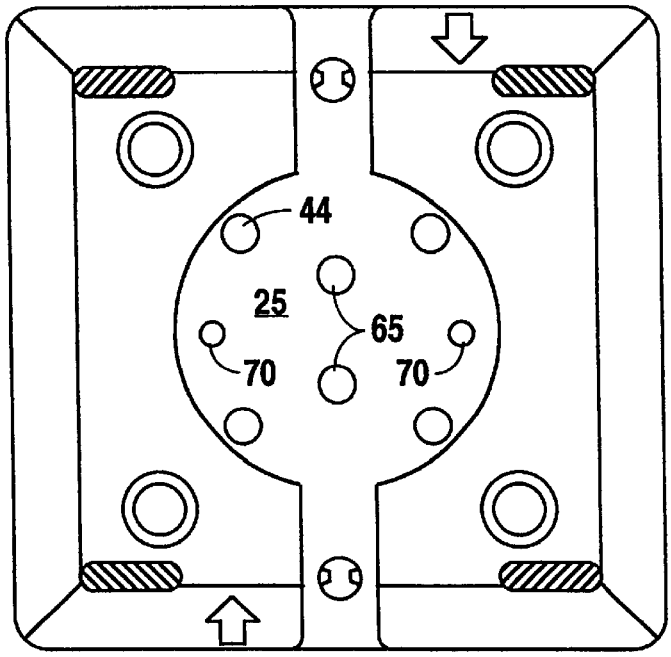
FIG. 7 is a top view of the fixed base of an embodiment of the present invention used with an adapter plate having slots.

FIG. 7 is a top plan view of base 24 showing base detent passages 70, connector openings 44 (used when the present inventive adapter plate 26 is not installed), and stud receiving openings 65. Openings 65 are threaded to secure the threaded base 46 of the stud 30.

Figure 8:
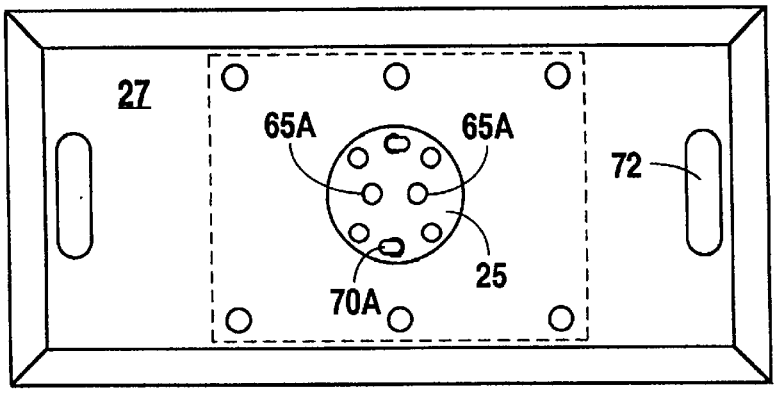
FIG. 8 is a top view of the portable base of an embodiment of the present invention.

FIG. 8 illustrates a top view of a portable base assembly 27 which may be used in combination with the present invention. The assembly may be lifted and carried by hand hold 72. Stud receiving openings 65A and base detent passages 70A may also be noted.

Figure 9:
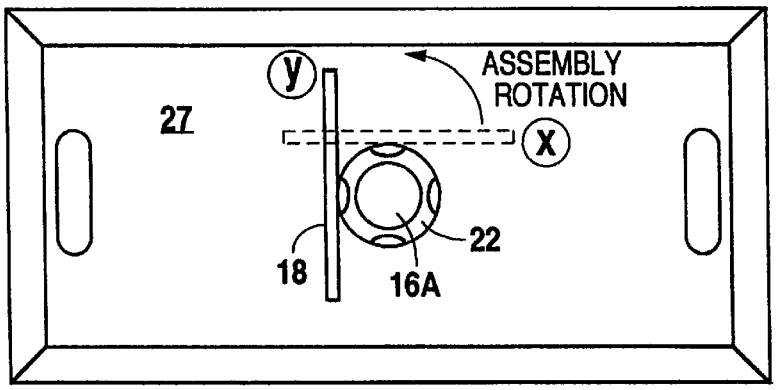
FIG. 9 is a top view of the portable base showing the positions for assembly.

FIG. 9 shows the method for the delineator system to be attached to the base 27. In position X the post 16A with the plate 26 attached to and beneath the load cell assembly 22 is positioned directly over the studs 30 attached to the base 27. The wide portion 80 (FIG. 3) of the slots 34 will allow the stud head 42 to easily fit through the slot 34 with the bottom of the head 42 above the recessed platform 35. In position Y the post and panel are rotated 90° and the narrow portion (82) of (FIG. 2) of the slot 34 will rotate along shoulder 44 beneath the stud head 42 thereby securing the delineator to the base.

Spring loaded locking detent pins 71 are inserted through the aligned passages 50, 38 (when the adapter plate is used) and 70 to prevent rotation of the connection and unintentional detachment of the delineator post from the base.

When the locking lever 170 is manually lifted, the locking detent ball 172 is free to retract into the pin shaft 174. The pin 71 may then be withdrawn from the detent passages 38 (when the adapter is used) and 70. Rotation of the lower load cell element 22 or 22A with respect to the base 24 or 24A is then possible. In one embodiment of the present invention the locking detent pin 71 remains a part of the lower load cell element. The detent pin is pressed into an interference fit with the passage 50. When the lever 170 is lifted the lower load cell along with the pin 71 are pulled from the adapter and/or base. This ensures that the pin 71 does not fall from the load cell and improves the speed of change-out of the delineator signage. No tool is required to disassemble the lower load cell 22 or 22A from the base 24 or 24A; again, improving the speed of change-out.

Figure 2A:
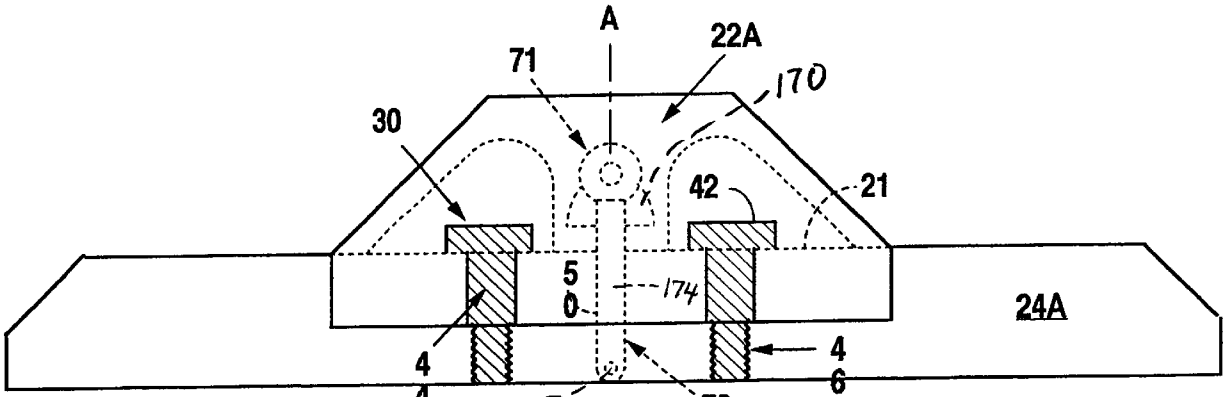
FIG. 2A is a cross-sectional view of the present invention without an adapter plate, and further illustrating the quick release alignment detent pin.

FIG. 2A illustrates an alternative embodiment of the present invention wherein the lower load cell element 22A is affixed directly to the base 24A without the adapter plate. The lower load cell element 22A is attached to the base 24A by studs 30 which have stud heads 42 at one end and are threadingly attached at second ends 46 to the base 24A.

Load cell element 22A is provided with radially aligned slots or openings 34A (FIG. 3A) in the cell shoulder 21. Slots 34A receive studs 30 in rotating engagement. Stud heads 42 hold the cell element 22A in engagement with the base 24A when the load cell element 22A is rotated about its vertical axis A (FIG. 2A).

Figure 3A:
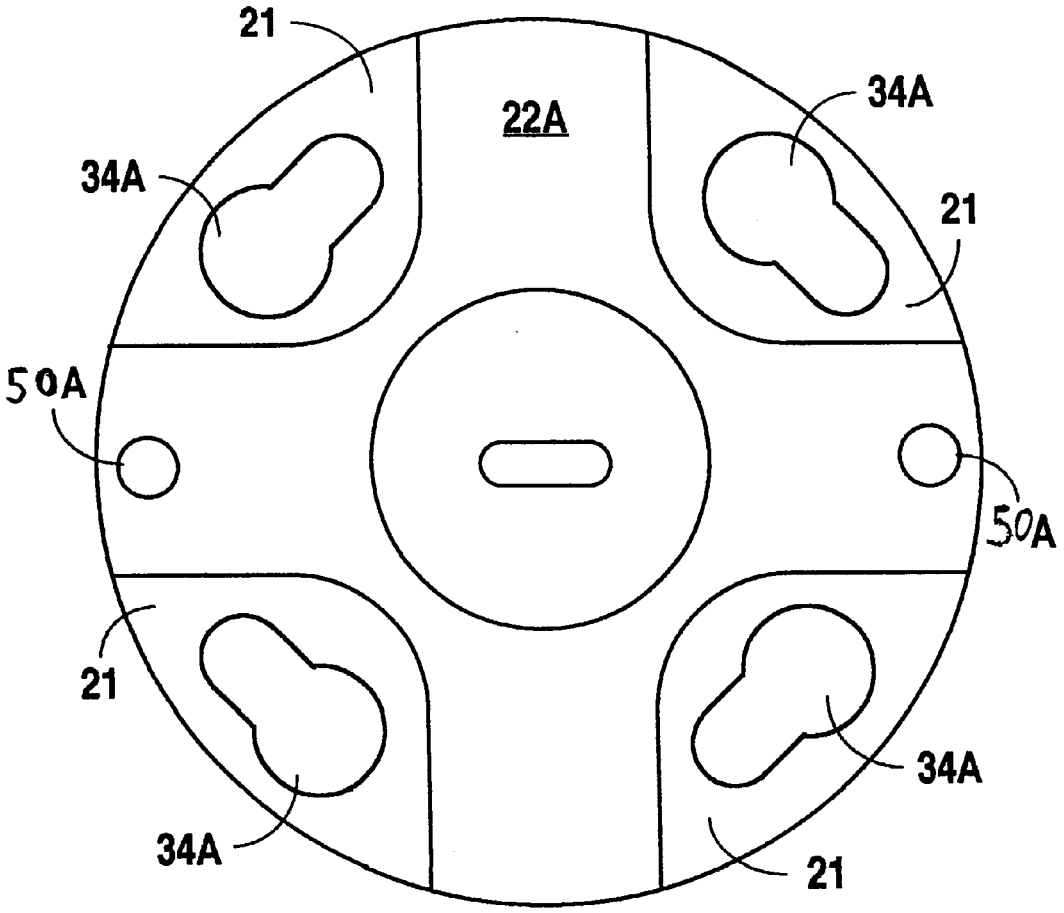
FIG. 3A is a top view of the lower load cell element of the present invention.

FIG. 3A shows the alternative embodiment of the load cell element 22A in a top plan view. Shoulders 21 contain the radially aligned slots 34A and allow the stud heads 42 sufficient clearance for rotation. Detent passages 50A are intended to accept detent pins 71 when the delineator system is properly assembled. As previously discussed, detent pin 71 may be slidably retractable from the passage 50A in some embodiments, but in others the pins 71 are retained in the passages via an interface fit. There is no need for additional threaded openings to secure the cell element 22A to the base 24A.

Figure 6A:
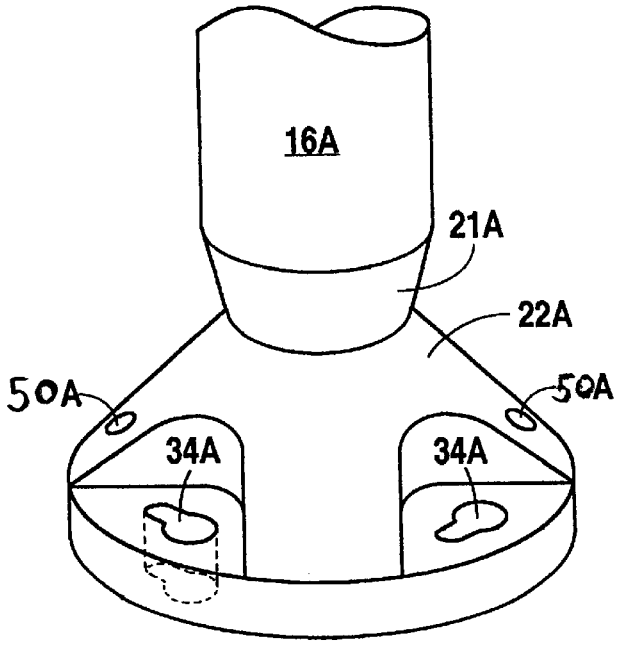
FIG. 6A is a top side perspective view of the post load cell assembly without an adapter plate, and slots in the lower load cell element.

FIG. 6A shows a perspective view of post 16A and alternative embodiment lower load cell element 22A. Load cell detent passages 50A extend through cell element 22A and align with passages 70 in the base 24A. When the post 16A is properly attached to base 24A, passages 50A and 70 will align and the base 24A receive detent pin 71.

Figure 7A:
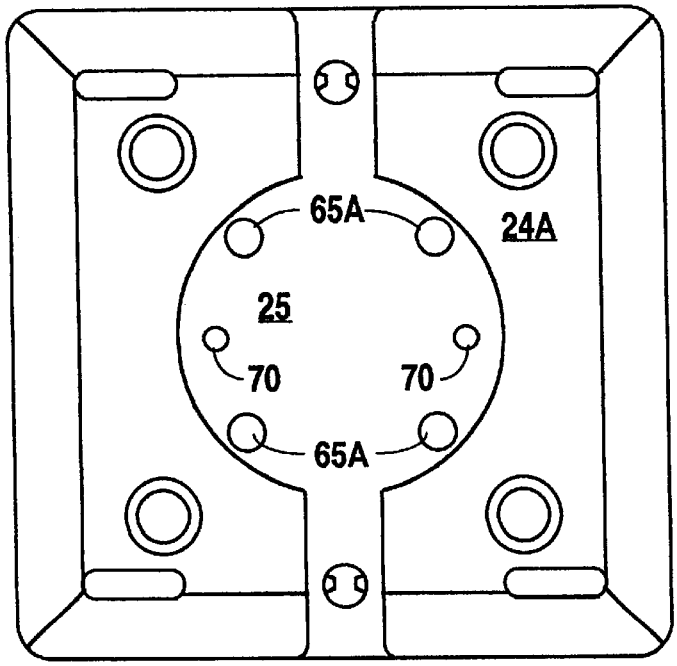
FIG. 7A is a top view of the fixed base of an embodiment of the present invention used with a lower load cell element having slots and quick release alignment detent pins.

FIG. 7A is a top plan view of base 24A showing base detent passages 70 and stud receiving openings 65A. Openings 65A are threaded to secure the thread end 46 of stud 30 to the base 24A.

Figure 8A:
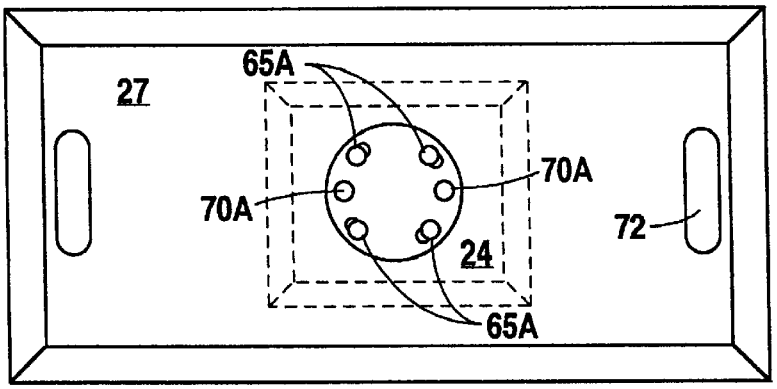
FIG. 8A is a top view of an alternative portable base of the present invention.

FIG. 8A illustrates a top view of a portable supporting assembly 27 which is used in combination with the present invention. The assembly 27 may be lifted and carried by hand hold 72. Base 24 or 24A is molded into and is an integral part of portable supporting surface assembly 27.

Stud receiving openings 65A and base detent passages 70A may also be noted.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

What is claimed is:

1. A quick release delineator apparatus comprising:

a load cell assembly having an upper and lower load cell element, said lower load cell element having slots in a shoulder portion of said lower load cell element and at least one cell alignment passage extending through said lower load cell element;

a delineator base member having studs extending upwardly from a load cell assembly receiving chamber in said delineator base member, said studs having head portions which cooperate with said slots to retain said lower load cell element to said base member upon rotation of said lower load cell element about said studs from a first position to a second position and at least one base alignment passage extending through said base member; and a quick release alignment detent pin secured within and extending through said cell alignment passage in said lower load cell element and releasably and slidingly passable through said base alignment passage in said base member when said lower load cell element is in said second position to maintain alignment of said lower load cell and said base member in said second position such that said lower load cell does not rotate back to said first position.

2. The apparatus of claim 1 wherein said slots are radially aligned in said shoulder portion of said lower load cell element, said slots having a wide portion sized to accept said stud head and a narrow portion narrower than said stud head.

3. The apparatus of claim 2 wherein said studs further comprise: a threaded distal section and a cylindrical shoulder portion, said shoulder portion having a diameter greater than said threaded distal section and said diameter less than the diameter of said head portion, said diameter of said shoulder portion approximately as wide as said narrow portion of said radially aligned slots.

4. The apparatus of claim 1 wherein said studs further comprise:

a threaded distal section and a cylindrical shoulder portion, said shoulder portion having a diameter greater than said threaded distal section and said diameter less than the diameter of said head portion.

5. The apparatus of claim 1 where said delineator base member is fixed to a supporting surface.

6. The apparatus of claim 1 wherein said delineator base member is portable.

7. The apparatus of claim 1 wherein said delineator base member is integrally molded as part of a supporting surface.

8. The apparatus of claim 1 wherein said detent pin further comprises a release lever on a first end of a pin shaft and a locking ball on an opposite end of said pin shaft, said locking ball engageable with said delineator base member to retain said lower load cell element in operative connection with said base member when said lever is in a first locked position.

9. The apparatus of claim 8 wherein said locking ball is releasable to move within said opposite end of said pin shaft when said lever is in a second unlocked position thereby allowing said lower cell element to be disengaged form said base member.

* * * * *